US009315065B2

(12) United States Patent
Nakanishi et al.

(10) Patent No.: US 9,315,065 B2
(45) Date of Patent: Apr. 19, 2016

(54) GLUE APPLICATION UNIT FOR PERFECT BINDING MACHINE

(75) Inventors: Hirohito Nakanishi, Shiga (JP); Kou Ohuchiyama, Shiga (JP); Takehito Yokogi, Shiga (JP); Akira Onodera, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 113 days.

(21) Appl. No.: 14/345,190

(22) PCT Filed: Sep. 16, 2011

(86) PCT No.: PCT/JP2011/071251
§ 371 (c)(1),
(2), (4) Date: Mar. 14, 2014

(87) PCT Pub. No.: WO2013/038559
PCT Pub. Date: Mar. 21, 2013

(65) Prior Publication Data
US 2014/0348616 A1 Nov. 27, 2014

(51) Int. Cl.
*B42C 9/00* (2006.01)

(52) U.S. Cl.
CPC ..... *B42C 9/0018* (2013.01); *B42C 9/00* (2013.01); *B42C 9/0006* (2013.01); *B42C 9/0012* (2013.01)

(58) Field of Classification Search
CPC ..... B42C 9/0012; B42C 9/00; B42C 9/006
USPC ..... 412/37
See application file for complete search history.

(56) References Cited

U.S. PATENT DOCUMENTS

2002/0061241 A1* 5/2002 Fischer ..... B42C 9/0012 412/37
2006/0156974 A1* 7/2006 Muller-Lorenschat B42C 9/0012 118/200
2008/0003080 A1* 1/2008 Abegglen ..... B42C 9/0012 412/37
2011/0008133 A1* 1/2011 Walther ..... B42C 9/0012 412/37

FOREIGN PATENT DOCUMENTS

DE 102 42 259 A1 3/2004
JP 50-149118 5/1974
JP 59-24387 Y2 7/1984
JP 2003-291559 A 10/2003
JP 2008-12913 A 1/2008

OTHER PUBLICATIONS

Extended European Search Report dated May 6, 2015, issued in counterpart application No. 11872471.5. (5 pages).
International Preliminary Report on Patentability form PCT/IB/373 dated Mar. 18, 2014, issued in International Application No. PCT/JP2011/071251 with form PCT/ISA/237 (7 pages).
International Search Report dated Nov. 1, 2011, issued in corresponding application No. PCT/JP2011/071251.

* cited by examiner

*Primary Examiner* — Kyle Grabowski
(74) *Attorney, Agent, or Firm* — Westerman, Hattori, Daniels & Adrian, LLP

(57) ABSTRACT

The gluing unit is provided with: a glue tank (2); a glue applicator roller (3) that applies the glue on the back (r) of a text block (P); a motor (4) that rotates the glue applicator roller; a wiper (6) that adjusts the amount of glue adhering to the glue applicator roller; a wiper drive mechanism that brings the wiper closer to or away from the glue applicator roller; and a control unit (10) that controls the wiper drive mechanism.

5 Claims, 8 Drawing Sheets

A

B

A

B

GLUE APPLICATION UNIT FOR PERFECT BINDING MACHINE

TECHNICAL FIELD

The present invention relates to a glue application unit for a perfect binding machine.

BACKGROUND ART

A conventional perfect binding machine comprises, for example, at least one clamp unit, a mechanism for moving the clamp unit along a path, and a series of binding units arranged under the path of the clamp unit, in which a book block is held by the clamp unit and then, while the book block is conveyed by the clamp unit along the path, the perfect binding is performed.

A glue application unit as one of the binding units is built in the perfect binding machine so as to apply glue to a back face of the book block during the passage of the clamp unit (cf. for example, Patent Document 1).

The glue application unit has a frame, a glue tank attached to the frame and filled with glue, a glue applying roller arranged in the glue tank and attached to the frame for rotation about a shaft thereof extending cross the path of the clamp, and a motor attached to the frame to rotate the glue applying roller. A lower part of the glue application roller is soaked in the glue of the glue tank and the glue application roller engages with the back face of the book block at its top face covered with the glue.

The glue application unit further comprises a wiper attached to the frame and located upstream of the top face of the glue application roller in a direction of the rotation of the glue application roller in such a way that the wiper can come into contact with and separate from the outer periphery of the glue application roller, and a wiper drive mechanism attached to the frame so as to actuate the wiper. A thickness of the glue covering the top face of the glue application roller can be adjusted by changing a distance between the outer periphery of the glue application roller and the wiper.

The glue application unit further comprises a control unit controlling the operation of the wiper drive mechanism.

Then the wiper is sequentially moved at an open position in which the wiper is separated from the outer periphery of the glue application roller by a predetermined distance and a closed position in which the wiper is made contact with the outer periphery of the glue application roller at a timing determined based on the information about a position of the book block on the path of the clamp unit, a speed of movement of the book block, a distance from the top face of the glue application roller to the wiper in a circumferential direction of the glue application roller, and a speed of the outer periphery of the glue application roller, so that the back face of the book block engages with the top face of the glue application roller covered with the glue of the predetermined thickness while the book block passes through the glue application roller.

The operation timing of the wiper will be described in more detail below with reference to accompanying drawings. FIG. 6 is a side view illustrating the operation timing of the wiper in case of rotating the glue application roller in the direction of movement of the book block.

Referring to FIG. 6A, the wiper W rotates from the closed position to the open position when the book block P reaches a position separated from the glue application roller R by a predetermined distance. Then, as shown in FIG. 6B, when the leading end of the book block P reaches the top face of the glue application roller R, the back face of the book block P engages with the top face of the glue application roller R covered with the glue G of a predetermined thickness. This engagement of the book block P with the glue application roller R continues during passage of a predetermined length of the book block P through the top face of the glue application roller R. As shown in FIG. 6C, when the predetermined length of the book block P passes through the top face of the glue application roller R, the wiper W rotates from the open position to the closed position. Thus, as shown in FIG. 6D, when the tail end of the book block P passes through the top face of the glue application roller R, the layer of the glue G on the outer periphery of the glue application roller R is cut off.

Consequently, as shown in FIG. 8A, the glue G of the predetermined thickness is applied to the back face of the book block P.

FIG. 7 is a side view illustrating the operation timing of the wiper in case of rotating the glue application roller in a direction opposite to the direction of movement of the book block P. Referring to FIG. 7A, the wiper W rotates from the closed position to the open position (a gap between the glue application roller R and the wiper W is the same as shown in FIG. 6) when the book block P reaches a position separated from the glue application roller R by a predetermined distance. Then, as shown in FIG. 7B, when the leading end of the book block P reaches the top face of the glue application roller R, the back face of the book block P engages with the top face of the glue application roller R covered with the glue G of a predetermined thickness. This engagement of the book block P with the glue application roller R continues during passage of a predetermined length of the book block P through the top face of the glue application roller R. As shown in FIG. 7C, when the predetermined length of the book block P passes through the top face of the glue application roller R, the wiper W rotates from the open position to the closed position. Thus, as shown in FIG. 7D, when the tail end of the book block P passes through the top face of the glue application roller R, the layer of the glue G on the outer periphery of the glue application roller R is cut off.

Consequently, as shown in FIG. 8B, the glue G of the predetermined thickness is applied to the back face of the book block P.

However, as can be seen in FIG. 8, in the conventional glue application unit, an amount of the glue G is more likely to be insufficient at the leading and tail end portions, in particular, the leading end portion of the back face of the book block P. The shortage of the glue applied to the leading end portion of the back face of the book block effects an incomplete filling of the glue between the book block and a cover at the leading end portion of the back face of the book block when a cover is attached to the book block in a subsequent cover attachment process, which leads to a book binding of inferior quality.

PRIOR ART DOCUMENTS

Patent Documents

Patent Document 1: Japanese Patent Application Publication No. 2003-291559

SUMMARY OF THE INVENTION

Problems to be Solved by the Invention

It is an object of the present invention to provide a glue application unit capable to apply a sufficient amount of glue to not only a middle portion but also leading and tail end portions of the back face of the book block.

Means for Solving the Problems

In order to achieve this object, according to the present invention, there is provided a glue application unit built in a perfect binding machine and arranged under a path of a clamp unit of the perfect binding machine so as to apply glue to a back face of a book block while the clamp unit passes through the glue application unit, the back face protruding downwardly from the clamp unit, the glue application unit comprising: a frame; a glue tank attached to the frame and filled with glue; a glue application roller arranged in the glue tank and attached to the frame so as to rotate around a shaft thereof extending across the path of the clamp unit, the glue application roller applying the glue to the back face of the book block; a motor attached to the frame and rotating the glue application roller, a part of the glue application roller being soaked in the glue of the glue tank, the glue application roller engaging with the back face of the book block at its top face covered with the glue; a wiper attached to the frame and arranged upstream of the top face of the glue application roller in a direction of rotation of the glue application roller in such a way that the wiper can contacts and separates from an outer periphery of the glue application roller to adjust an amount of the glue covering the outer periphery of the glue application roller; a wiper drive mechanism attached to the frame so as to move the wiper; and a control unit controlling the wiper drive mechanism, the wiper being moved between an open position in which the wiper is separated from the outer periphery of the glue application roller and a closed position in which the wiper is made contact with the outer periphery of the glue application roller at a timing determined based on the information about a length of the back face of the book block, the information about a position of the book block on the path of the clamp unit, a speed of movement of the book block, a distance from the top face of the glue application roller to the wiper in a circumferential direction of the glue application roller, and a speed of the outer periphery of the glue application roller, so that the back face of the book block engages with the top face of the glue application roller covered with the glue of the predetermined thickness while the book block passes through the glue application roller, wherein the wiper is sequentially located at a first open position in which the wiper is separated from the outer periphery of the glue application roller by a first distance, a second open position in which the wiper is separated from the outer periphery of the glue application roller by a second distance which is shorter than the first distance, and the closed position during the passage of the book block through the glue application roller, whereby a leading end portion of the back face of the book block engages with the top face of the glue application roller covered with the glue of a first thickness while middle and tail end portions of the back face of the book block engages with the top face of the glue application roller covered with the glue of a second thickness which is smaller than the first thickness.

According to a preferred embodiment of the present invention, on the way to the closed position from the second open position, the wiper is located at a third open position in which the wiper is separated from the outer periphery of the glue application roller by a third distance which is longer than the second distance, whereby the leading end portion of the back face of the book block engages with the top face of the glue application roller covered with the glue of the first thickness, the middle portion of the back face of the book block engages with the top face of the glue application roller covered with the glue of the second thickness, and the tail end portion of the back face of the book block engages with the top face of the glue application roller covered with the glue of a third thickness which is greater than the second thickness.

According to another preferred embodiment of the present invention, the glue application roller is rotated in a forward or backward direction of the direction of movement of the book block.

According to a further preferred embodiment of the present invention, the wiper is fixed to a rotary shaft attached to the frame and extending across the path of the clamp unit in such a way that the wiper swings with rotation of the rotary shaft, and the wiper drive mechanism comprises: a motor attached to the frame and having a drive shaft extending parallel to the rotary shaft; a first lever fixed to the drive shaft of the motor so as to swing with rotation of the drive shaft; and a second lever fixed to the rotary shaft so as to swing with rotation of the rotary shaft, wherein a pin is attached to the distal end of the first lever and guided within a recess formed on the distal end of the second lever in such a way that the first and second levers are operatively connected with each other, and the first and second levers swing in directions toward and away from the outer periphery of the glue application roller with clockwise and counterclockwise rotations of the drive shaft of the motor, whereby the wiper swings between the position in which the wiper contacts with the outer periphery of the glue application roller and the position in which the wiper separates from the outer periphery of the glue application roller.

Effect of the Invention

According to the present invention, the wiper is sequentially positioned at the first open position, the second open position and the closed position, so that during the passage of the book block through the glue application roller, the leading end portion of the back face of the book block engages with the top face of the glue application roller covered with the glue of the first thickness, while the remaining portion (the middle and tail end portions) of the back face of the book block engages with the top face of the glue application roller covered with the glue of the second thickness which is smaller than the first thickness. Consequently, an amount (a thickness) of the glue applied to the leading end portion of the back face of the book block is more than an amount (a thickness) of the glue applied to the remaining portion (the middle and tail end portions) of the back face of the book block, and thereby an adequate amount of the glue is charged between the book block and a cover when the cover is attached to the back face of the book block in a subsequent cover attachment process, which leads to a book binding of high quality.

BEST MODE FOR CARRYING OUT THE INVENTION

Figure 1:
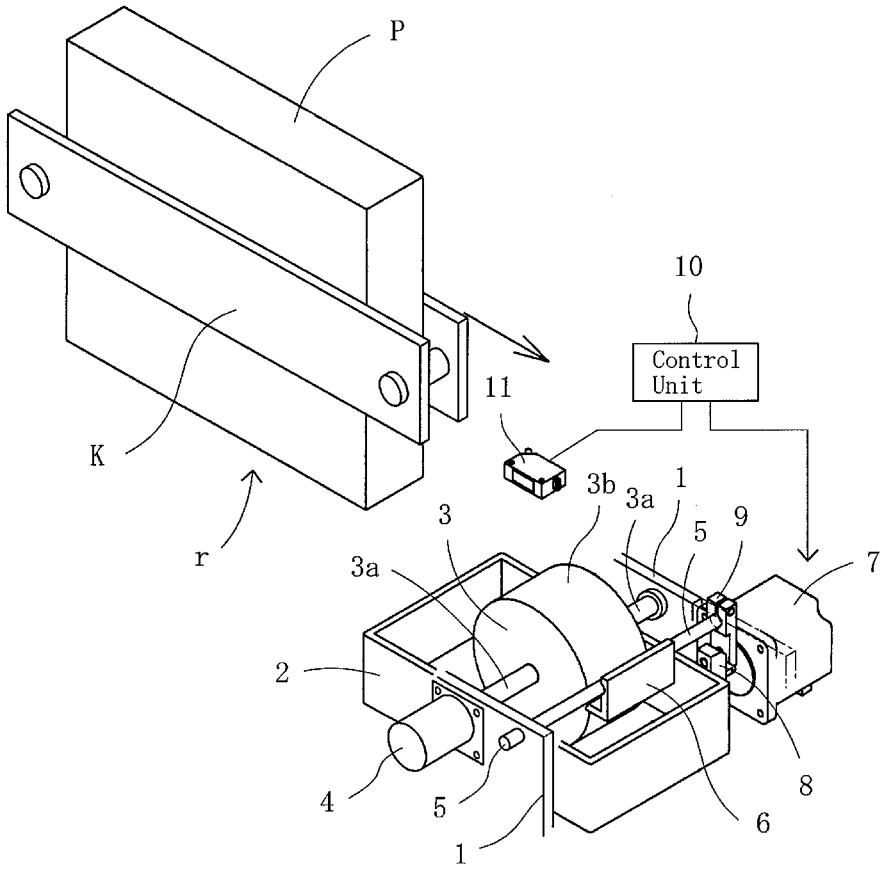
FIG. 1 is a perspective view schematically showing a structure of a glue application unit for a perfect binding machine in accordance with one embodiment of the present invention.

A preferred embodiment of the present invention will be described below with reference to accompanying drawings. FIG. 1 is a perspective view showing a main part of a glue application unit for a perfect binding machine according to one embodiment of the present invention. FIG. 2A is a side view illustrating the operation of a wiper of the glue application unit shown in FIG. 1, in which the wiper is located at a closed position, and FIG. 2B is a side view illustrating the operation of a wiper of the glue application unit shown in FIG. 1, in which the wiper is located at an open position.

Referring to FIG. 1, a glue application unit of the present invention is built in a perfect binding machine and arranged under a path of a clamp unit K so as to apply glue to a back face r of a book block P while the clamp unit K passes through the glue application unit, the back face r protruding downwardly from the clamp unit K.

As shown in FIG. 1, the glue application unit has a frame 1 and a glue tank 2 attached to the frame 1 and filled with glue. The glue is a kind of glue which is melted by heating such as hot-melt adhesive. The glue tank 2 is heated by a heater (not shown) in the operation of the glue application unit.

The glue application unit has a glue application roller 3 arranged in the glue tank 2, attached to the frame 1 so as to rotate around its horizontal shaft 3*a* extending across the path of the clamp unit K, and applying the glue to the back face r of the book block P. The glue application unit also has a motor 4 attached to the frame 1 and connected to the shaft 3*a* of the glue application roller 3 so as to rotate the roller 3.

A part (a lower portion) of the glue application roller 3 is soaked in the glue of the glue tank 2 and the glue application roller 3 engages with the back face r of the book block P at its top face 3*b* covered with the glue. The glue application roller 3 is rotated by the motor 4 at a constant rate in the same direction as or a direction opposite to the direction of motion of the clamp unit K. In the embodiment shown in FIG. 1, the glue application roller 3 is rotated in a direction opposite to the direction of motion of the clamp unit K.

The glue application unit also has a wiper 5 attached to the frame 1 and arranged upstream of the top face 3*b* of the glue application roller 3 in a direction of the rotation of the glue application roller 3 so as to adjust an amount (a thickness) of the glue covering the outer periphery of the glue application roller 3. The wiper 6 is fixed to a horizontal rotary shaft 5 attached to the frame 1 and extending across the path of the clamp K in such a way that the wiper 6 swings with rotation of the rotary shaft 5.

The glue application unit further has the wiper drive mechanism actuating the wiper 6.

Figure 2:
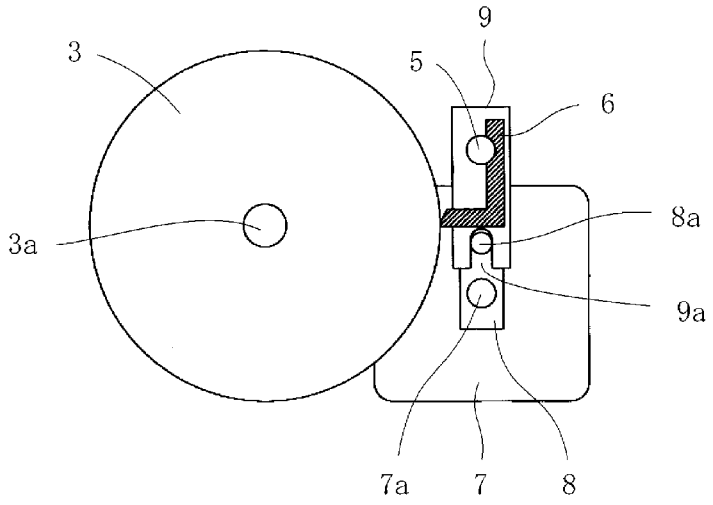
FIG. 2A is a side view illustrating the operation of a wiper of the glue application unit shown in FIG. 1, in which the wiper is located at a closed position.
FIG. 2B is a side view illustrating the operation of a wiper of the glue application unit shown in FIG. 1, in which the wiper is located at an open position.
Figure 2:
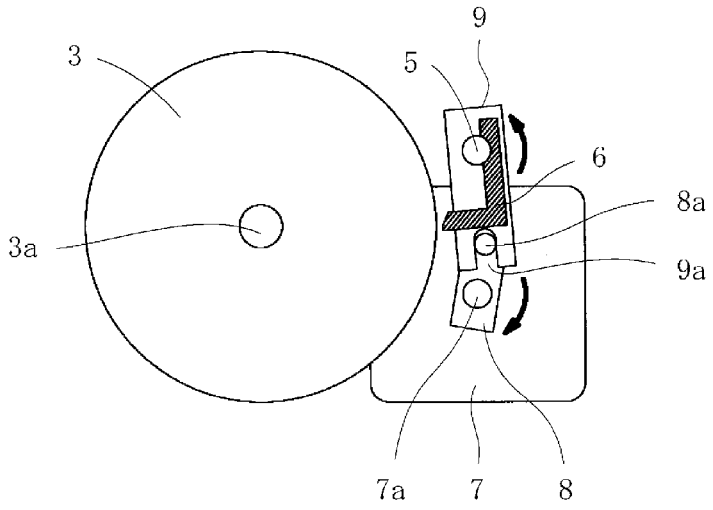

As shown in FIGS. 1 and 2, the wiper drive mechanism comprises a motor 7 attached to the frame 1 and having a drive shaft 7*a* extending parallel to the rotary shaft 5, a first lever 8 fixed to the drive shaft 7*a* of the motor 7 so as to awing with rotation of the drive shaft 7*a*, and a second lever 9 fixed to the rotary shaft 5 so as to swing with rotation of the rotary shaft 5. A pin 8*a* is attached to the distal end of the first lever 8 and a recess 9*a* is formed on the distal end of the second lever 9. The pin 8*a* is guided within the recess 9*a* is such a manner that the first and second levers 8, 9 are operatively connected with each other.

Then, with clockwise and counterclockwise rotations of the drive shaft 7*a* of the motor 7, the first lever 8 swings and thereby the second lever 8 swings in directions toward and away from the outer periphery of the glue application roller 3. Further, the swing motion of the second lever 8 is transmitted to the wiper 8 through the rotary shaft 5, so that the wiper 6 swings between a closed position (FIG. 2A) in which the wiper 6 contacts with the outer periphery of the glue application roller 3 and an open position (FIG. 2B) in which the wiper 6 separates from the outer periphery of the glue application roller 3.

Thus a gap between the wiper 6 and the outer periphery of the glue application roller 3 is adjusted, so that the amount (the thickness) of the glue covering the outer periphery of the glue application roller 3 is adjusted.

The glue application unit further has a control unit 11 controlling the wiper drive mechanism. The control unit 11 controls the wiper drive mechanism in such a manner that the wiper is sequentially located at a first open position in which the wiper is separated from the outer periphery of the glue application roller 3 by a first distance, a second open position in which the wiper 6 is separated from the outer periphery of the glue application roller 3 by a second distance which is shorted than the first distance, and the closed position at a timing determined based on the information about a length of the back face of the book block, the information about a position of the book block on the path of the clamp unit, a speed of movement of the book block, a distance from the top face of the glue application roller to the wiper in a circumferential direction of the glue application roller, and a speed of the outer periphery of the glue application roller.

In this case, preferably, a gap between the wiper 6 and the outer periphery of the glue application roller 3 at the first open position of the wiper is 1.1-1.7 times larger than a gap between the wiper 6 and the outer periphery of the glue application roller 3 at the second open position of the wiper 6.

Thereby, during the passage of the book block P through the glue application roller 3, the leading end portion of the back face r of the book block P engages with the top face 3*b* of the glue application roller 3 covered with the glue of a first thickness, and the middle and tail end portions of the back face r of the book block P engages with the top face 3*b* of the glue application roller 3 covered with the glue of a second thickness which is smaller than the first thickness.

A method of determining the operation timing of the wiper drive mechanism, that is, the wiper 6 is as follows.

Figure 3:
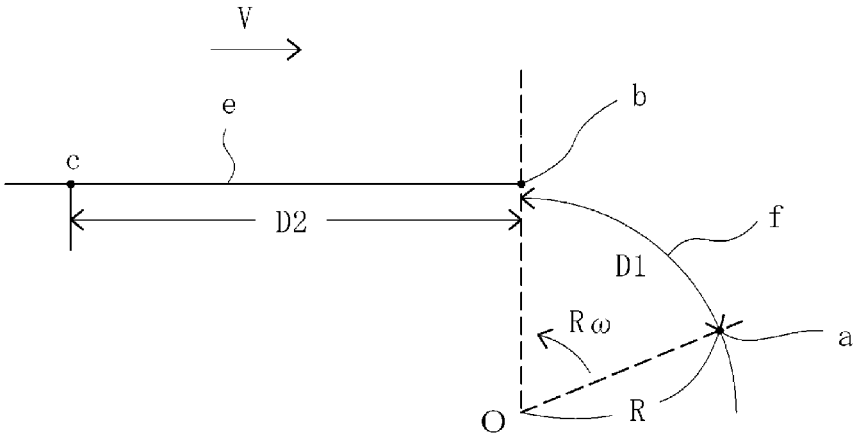
FIG. 3 is a schematic view illustrating a method of determination the operation timing of the wiper of the glue application unit shown in FIG. 1.

FIG. 3 is a schematic view illustrating the method of determining the operation timing of the wiper 6. In FIG. 3, an alphabet "a" designates a position of the wiper 6, an alphabet "b" designates a position of the top face 3*b* of the glue application roller 3, an alphabet "e" designates the path of the book block P, and an alphabet "f" designates the outer periphery of the glue application roller 3. Further, an alphabet "O" designates the center of the glue application roller 3 and an alphabet "R" designates a radius of the glue application roller 3.

Referring to FIG. 3, a time t required for the glue located at the position a to arrive at the position b is determined by the following equation:

$$t=D1/(R\cdot\omega),$$

where D1 represents a distance from the top face b of the glue application roller to the wiper a in a circumferential direction of the glue application roller, and ω represents a revolution speed (an angular velocity) of the glue application roller.

On the other hand, a travel distance D2 of the book block during the time t is obtained as $$D2=V\cdot t=V\cdot D1/(R\cdot\omega),$$

where V represents a speed of movement of the book block.

Thus a point c separated from the top face b of the glue application roller by a distance D2=V·D1/(R·ω) is set as a reference point of control. Then the operation timing of the wiper is determined as follows:

(1) Until the leading end of the book block P reaches the reference point c;

The wiper is located at the closed position.

Figure 4:
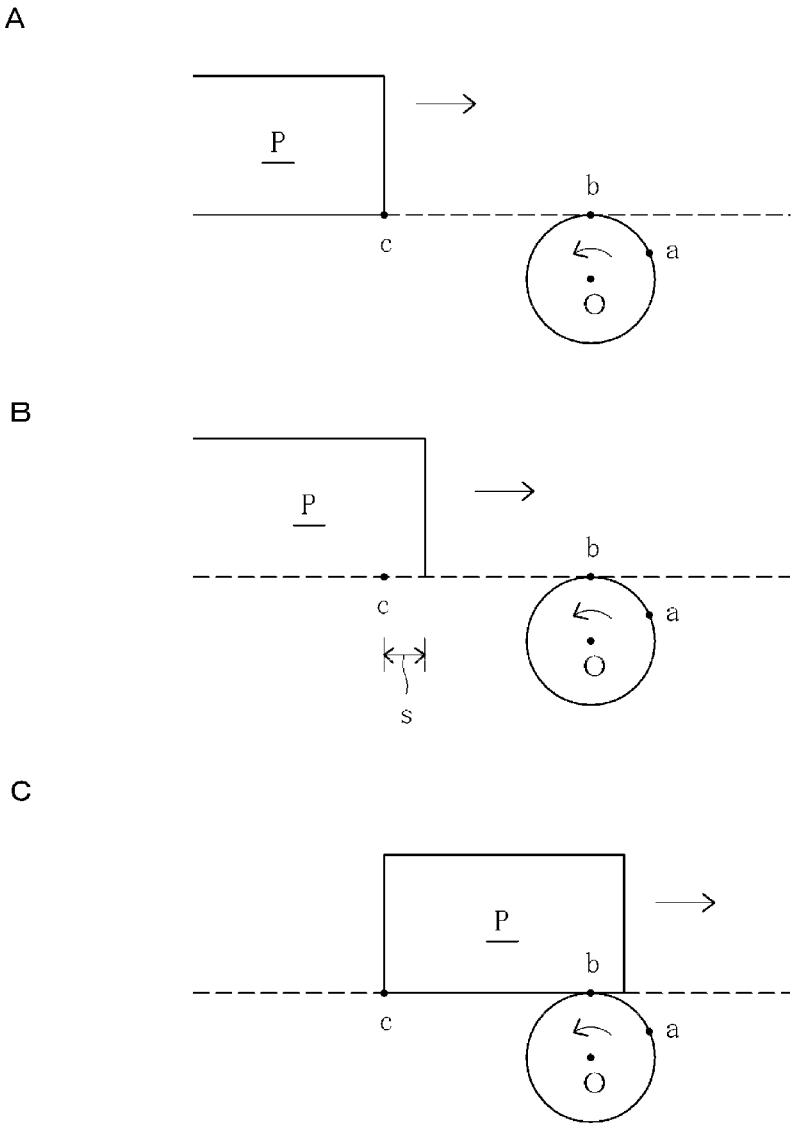
FIG. 4 is a schematic view illustrating a method of determination of the operation timing of the wiper of the glue application unit shown in FIG. 1.

(2) Until a predetermined length s of the book block P (corresponding to a length of the leading end portion of the back face of the book block P) passes through the reference point c after the leading edge of the book block P reaches the reference point c (see, FIGS. 4A-4B);

The wiper is located at the first open position.

(3) Until the tail end of the book block P reaches the reference point c after the leading end portion of the book block P passes through the reference point c (see, FIGS. 4B-4C);

The wiper is located at the second open position.

(4) After the tail end of the book block P passes through the reference point c (see, FIG. 4C);

The wiper is located at the closed position.

A position of the book block P on the path thereof is detected by a sensor 11 (see, FIG. 1). The sensor 11 is arranged at the reference point c or an arbitrary position upstream of the reference point c. In the former, the leading and tail ends of the book block P are respectively detected by the sensor 11 when they passes through the reference point c.

In the latter, a spare time is provided before the book block P reaches the reference point c after the detection of the book block P by the sensor 11, thereby the total length of the back face of the book block P is measured by the sensor 11 before the tail end of the book block P reaches the reference point c after the passage of the leading end of the book block P through the reference point c.

Then a time when each of the leading and tail ends of the book block P reaches the reference point c is calculated as follows.

(a) The time when the leading end of the book block reaches the reference point c;

A time when a time t1=[(a distance from the sensor to the reference point c)/(the speed of movement of the book block P)] elapses after the leading end of the book block P is detected by the sensor 11.

(b) The time when the tail end of the book block P reaches the reference point c;

A time when a time t2=[(the total length of the book block P)/(the speed of movement of the book block P)] elapses after the leading end of the book block P reaches the reference point c.

In this embodiment, though the position of the book block P on the path thereof is the sensor 11, instead of arranging the sensor 11, the detection of position of the book block P on the path thereof may be conducted by using pulse signals generated form an encoder attached to a clamp unit drive mechanism moving the clamp unit K. In the former, the length of the leading end portion of the back face the book block P is required as the information of the length of the book block P, while in the latter, the total length of the book block P as well as the length of the leading end portion of the back face of the book block P are required as the information of the length of the book block P. The information of the length of the book block P is stored in a memory of the control unit 10 preliminarily, or inputted by an operator through an input section such as a touch panel screen in each case and stored in the memory of the control unit 10.

Figure 5:
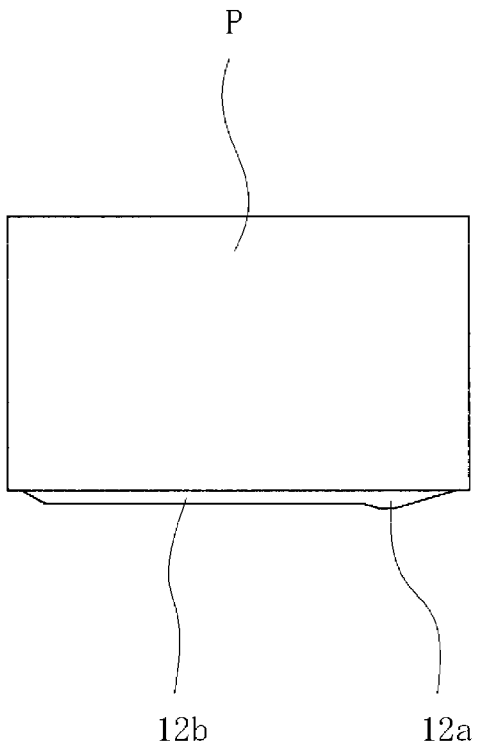
FIG. 5 is a side view of a book block whose back face has glue applied by the glue application unit shown in FIG. 1.
Figure 6:
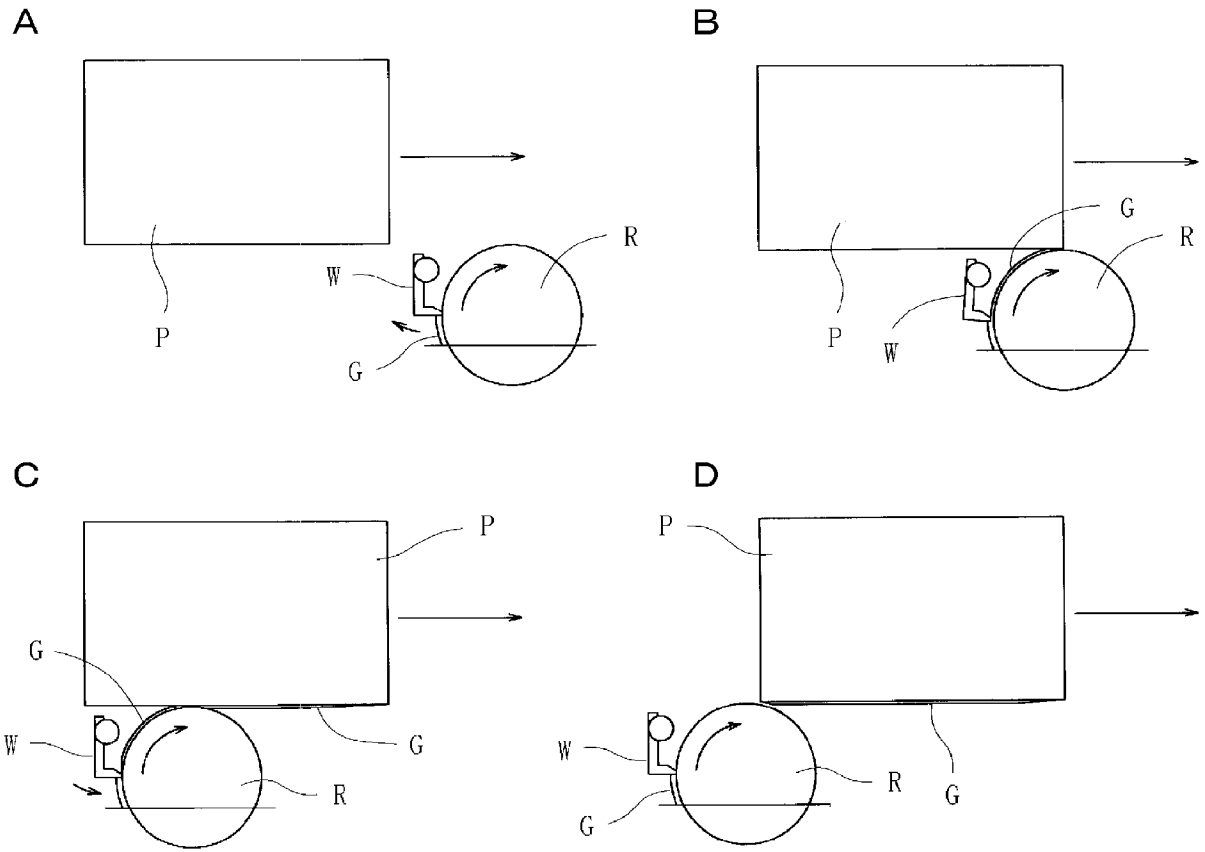
FIG. 6 is a side view illustrating the operation timing of a wiper of a conventional glue application unit in which a glue application roller is rotated in a direction of movement of a book block.
Figure 7:
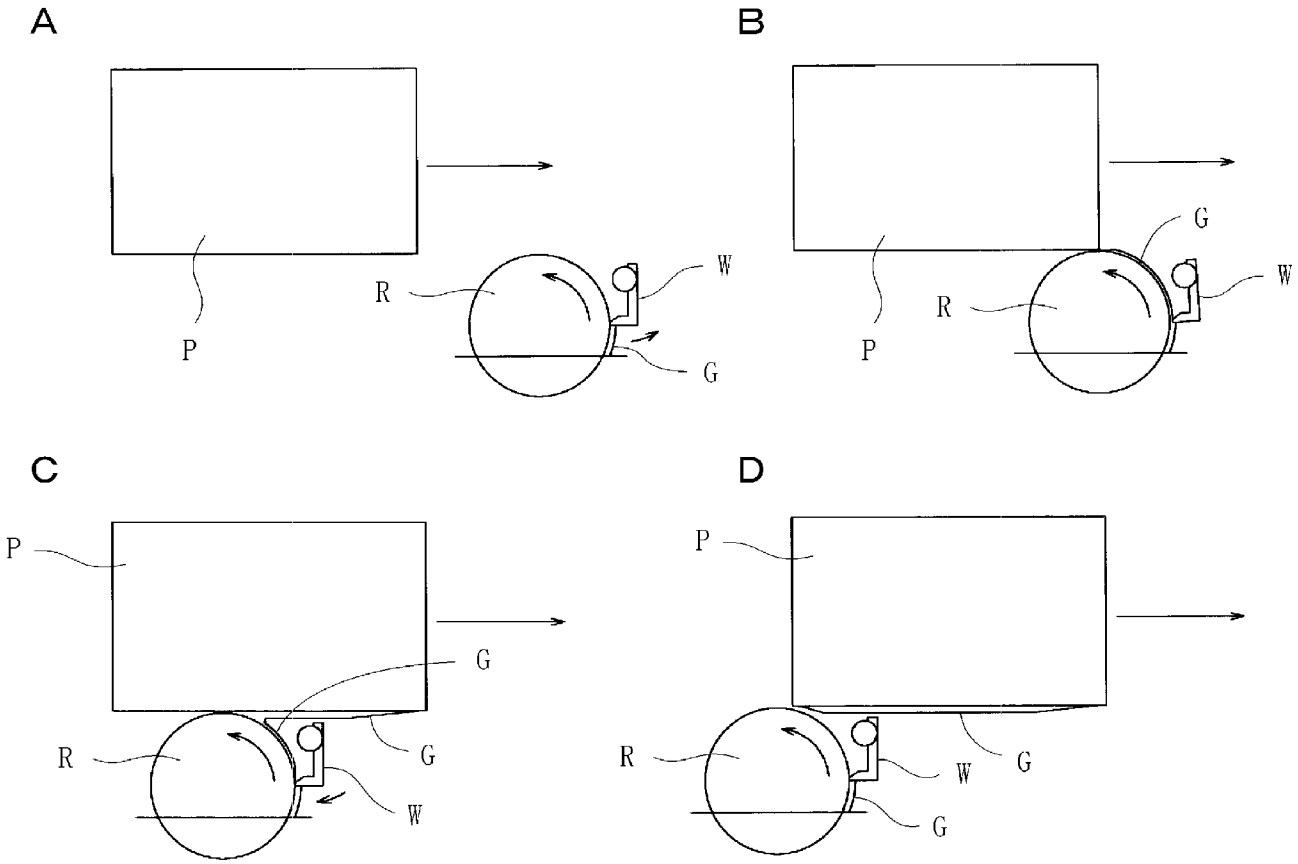
FIG. 7 is a side view illustrating the operation timing of a wiper of a conventional glue application unit in which a glue application roller is rotated in a direction opposite to a direction of movement of a book block.
Figure 8:
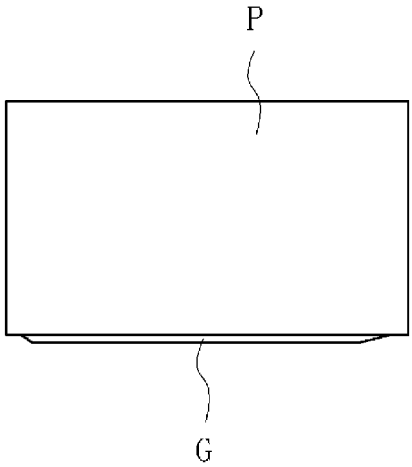
FIG. 8A is a side view of a book block whose back face has glue applied by the conventional glue application unit shown in FIG. 6.
FIG. 8B is a side view of a book block whose back face has glue applied by the conventional glue application unit shown in FIG. 7.
Figure 8:
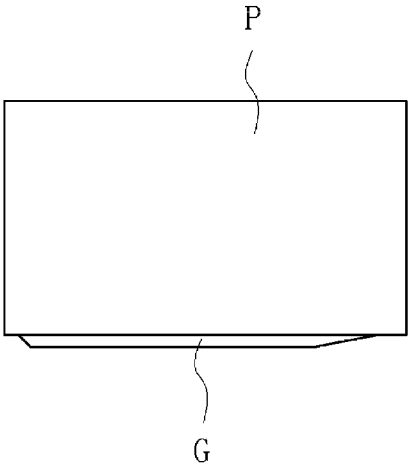

Thus, according to this embodiment, as shown in FIG. 5, an amount (a thickness) of the glue applied to the leading end portion 12*a* of the back face of the book block P is more (larger) than an amount (a thickness) of the glue 12*b* applied to the remaining portion (the middle and tail end portions) of the back face of the book block P. Thereby an adequate amount of the glue is charged between the book block and a cover when the cover is attached to the back face of the book block in a cover attachment process following the glue application process, and a book binding of high quality is achieved.

Although the present invention has been explained based on one preferred embodiment thereof, the structural features of the present invention are not limited to this embodiment. One skilled in the art can easily devise various modified embodiments within the scope of the claims of the present application.

For example, in the above-mentioned embodiment, the amount (the thickness) of the glue applied to the leading end portion of the back face of the book block is more (larger) than the amount (the thickness) of the glue applied to the remaining portion of the back face of the book block, but, instead of it, the amount of the glue applied to the leading and tail end portions of the back face of the book block may be more (larger) than the amount (the thickness) of the glue applied to the middle portion of the back face of the book block.

In this case, the wiper is sequentially located at four positions, that is, a first open position in which the wiper is separated from the outer periphery of the glue application roller by a first distance, a second open position in which the wiper is separated from the outer periphery of the glue application roller by a second distance which is shorter than the first distance, a third open position in which the wiper is separated from the outer periphery of the glue application roller by a third distance which is longer than the second distance, and a closed position in which the wiper is made contact with the outer periphery of the glue application roller.

Consequently, while the book block passes through the glue application roller, the leading end portion of the back face of the book block engages with the top face of the glue application roller covered with the glue of a first thickness, the middle portion of the back face of the book block engages with the top face of the glue application roller covered with the glue of a second thickness which is shorter than the first thickness, and the tail end portion of the back face of the book block engages with the top face of the glue application roller covered with the glue of a third thickness which is greater than the second thickness. In this case, a configuration in which the third distance equals to the first distance is allowed.

In this embodiment, the operation timing of the wiper is determined as follows.

(1) Until the leading end of the book block P reaches the reference point c;

The wiper is located at the closed position.

(2) Until a predetermined length of the book block P (corresponding to a length of the leading end portion of the back face of the book block P) passes through the reference point c after the leading edge of the book block P reaches the reference point c;

The wiper is located at the first open position.

(3) Until a leading edge of the tail end portion of the back face of the book block P reaches the reference point c after the leading end portion of the back face of the book block passes through the reference point c;

The wiper is located at the second open position.

(4) Until the tail end of the book block P reaches the reference point c after the leading edge of the tail end portion of the back face of the book block P passes through the reference point c;

The wiper is located at the third open position.

(5) After the tail end of the book block P passes through the reference point c;

The wiper is located at the closed position.

DESCRIPTION OF REFERENCE SIGNS

1 Frame
2 Glue tank
3 Glue application roller
3*a* Shaft
3*b* Top face
4 Motor
5 Rotary shaft
6 Wiper
7 Motor
7*a* Drive shaft
7*b* Scraping portion
8 First lever
8*a* Pin
9 Second lever
9*a* Recess
10 Control unit
11 Sensor
12*a* Glue applied to leading end portion of back face of book block
12*b* Glue applied to remaining portion of back face of book block
K Clamp unit
P Book block
r Back face

The invention claimed is:

1. A perfect binding machine comprising a clamp unit and a glue application unit which is arranged under a path of a clamp unit so as to apply glue to a back face of a book block while the clamp unit passes through the glue application unit, the back face protruding downwardly from the clamp unit, the glue application unit comprising:

a frame;

a glue tank attached to the frame and filled with glue;

a glue application roller arranged in the glue tank and attached to the frame so as to rotate around a shaft thereof extending across the path of the clamp unit, the glue application roller applying the glue to the back face of the book block;

a motor attached to the frame and rotating the glue application roller, a part of the glue application roller being soaked in the glue of the glue tank, the glue application roller engaging with the back face of the book block at its top face covered with the glue;

a wiper attached to the frame and arranged upstream of the top face of the glue application roller in a direction of rotation of the glue application roller in such a way that the wiper can contact and separate from an outer periphery of the glue application roller to adjust an amount of the glue covering the outer periphery of the glue application roller;

a wiper drive mechanism attached to the frame so as to move the wiper; and a control unit configured to control the wiper drive mechanism, the wiper being movable between an open position in which the wiper is separated from the outer periphery of the glue application roller and a closed position in which the wiper is brought into contact with the outer periphery of the glue application roller at a timing determined based on the information about a length of the back face of the book block, the information about a position of the book block on the path of the clamp unit, a speed of movement of the book block, a distance from the top face of the glue application roller to the wiper in a circumferential direction of the glue application roller, and a speed of the outer periphery of the glue application roller, so that the back face of the book block can engage with the top face of the glue application roller covered with the glue of the predetermined thickness while the book block passes through the glue application roller, wherein the wiper is sequentially located at a first open position in which the wiper is separated from the outer periphery of the glue application roller by a first distance, a second open position in which the wiper is separated from the outer periphery of the glue application roller by a second distance which is shorter than the first distance, and the closed position during the passage of the book block through the glue application roller, whereby a leading end portion of the back face of the book block engages with the top face of the glue application roller covered with the glue of a first thickness while middle and tail end portions of the back face of the book block engages with the top face of the glue application roller covered with the glue of a second thickness which is smaller than the first thickness.

2. The perfect binding machine according to claim 1, wherein, on the way to the closed position from the second open position, the wiper is located at a third open position in which the wiper is separated from the outer periphery of the glue application roller by a third distance which is longer than the second distance.

3. The perfect binding machine according to claim 1 or claim 2, wherein the glue application roller is rotated in a forward or backward direction of the direction of movement of the book block.

4. The perfect binding machine according to claim 3, wherein the wiper is fixed to a rotary shaft attached to the frame and extending across the path of the clamp unit in such a way that the wiper swings with rotation of the rotary shaft, the wiper drive mechanism comprises:

a motor attached to the frame and having a drive shaft extending parallel to the rotary shaft;

a first lever fixed to the drive shaft of the motor so as to swing with rotation of the drive shaft; and a second lever fixed to the rotary shaft so as to swing with rotation of the rotary shaft, wherein a pin is attached to the distal end of the first lever and guided within a recess formed on the distal end of the second lever in such a way that the first and second levers are operatively connected with each other, and the first and second levers swing in directions toward and away from the outer periphery of the glue application roller with clockwise and counterclockwise rotations of the drive shaft of the motor, whereby the wiper swings between the position in which the wiper contacts with the outer periphery of the glue application roller and the position in which the wiper separates from the outer periphery of the glue application roller.

5. The glue application unit according to claim 2, wherein the glue application roller is rotated in a forward or backward direction of the direction of movement of the book block.

* * * * *